United States Patent [19]

Davis

[11] Patent Number: 4,769,974

[45] Date of Patent: Sep. 13, 1988

[54] PROCESS AND APPARATUS FOR GAS PURGING OF A BAG BEING FORMED, FILLED AND SEALED ON A BAGGING MACHINE

[75] Inventor: Steven D. Davis, Yuciapa, Calif.

[73] Assignee: W. A. Lane, Inc., San Bernardino, Calif.

[21] Appl. No.: 79,344

[22] Filed: Jul. 30, 1987

[51] Int. Cl.[4] ..... B65B 3/18; B65B 9/02

[52] U.S. Cl. ..... 53/433; 53/434; 53/451; 53/511; 53/554

[58] Field of Search ..... 53/433, 434, 511, 451, 53/450, 554, 553, 555; 141/7, 8, 10, 126, 115

[56] References Cited

U.S. PATENT DOCUMENTS

| | | | |
|---|---|---|---|
| 2,145,941 | 2/1939 | Maxfield | 53/433 |
| 2,160,367 | 5/1939 | Maxfield | 53/433 |
| 3,040,490 | 6/1962 | Virta | 53/434 |
| 3,579,945 | 5/1971 | Buchner et al. | 53/511 |
| 3,664,086 | 5/1972 | James et al. | 53/511 |
| 4,241,563 | 12/1980 | Muller et al. | 53/511 |
| 4,566,249 | 1/1986 | Schwerdtel et al. | 53/511 X |
| 4,617,779 | 10/1986 | Nygren et al. | 53/511 X |

*Primary Examiner*—James F. Coan
*Assistant Examiner*—Steven P. Weihrouch
*Attorney, Agent, or Firm*—Herb Boswell

[57] ABSTRACT

For a form, fill and seal bagging machine a process and apparatus are provided whereby simultaneous with product discharged into the interior of the bag during the filling segment of the form, fill and seal cycle, a gas is also discharged into the interior of the bag to purge the interior of the bag and further, a low pressure area is created within the interior of the bag to remove excess purging gas and/or condensing fluids from the interior of the bag prior to sealing the bag.

14 Claims, 2 Drawing Sheets

FIG 3
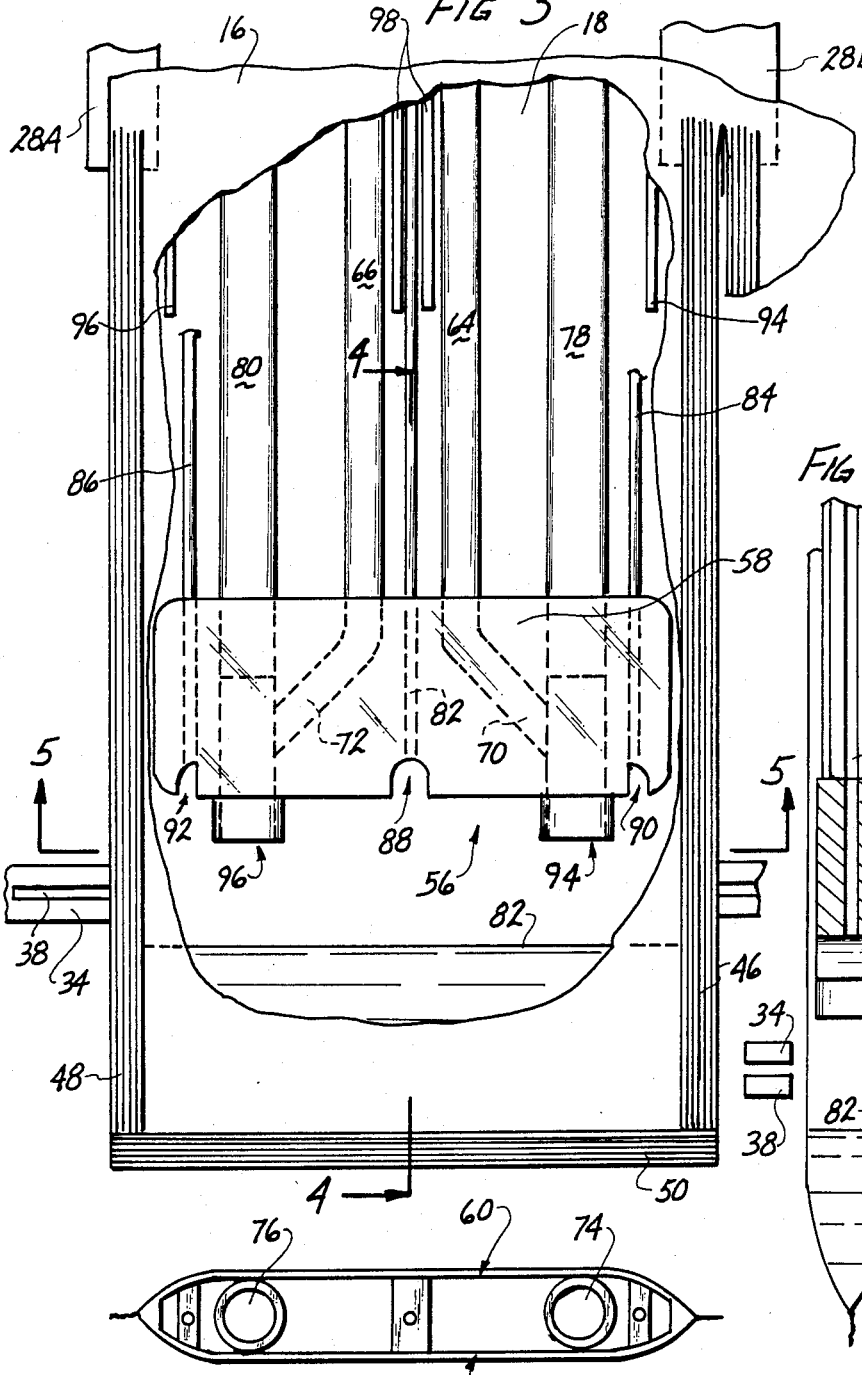
FIG 4
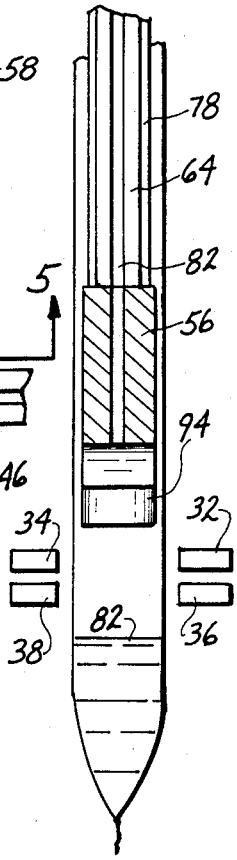
FIG 5

PROCESS AND APPARATUS FOR GAS PURGING OF A BAG BEING FORMED, FILLED AND SEALED ON A BAGGING MACHINE

BACKGROUND OF THE INVENTION

This invention is directed to a process and apparatus for gas purging of the interior of a bag or pouch which is being formed, filled, and sealed on a bagging type packaging machine. The atmospheric purge process and the apparatus for this process assists in formation of a better final seal on the bag and/or for introduction of specific atmospheres to be incorporated within the sealed bag or pouch.

In the packaging industry the word "seal" is used for both the hardware which forms "seals" or joints and also for the "seal" itself. Thus, side seals (hardware) form side seals (joints) between packaging films. In using the words "seal" or "seals" in this specification, if its meaning is not clear from the context of the sentence it is used in, it will be more fully identified by adjectives or synonyms.

With the advent and growth of certain industries, most particularly the fast or convenience food industry, machines have been developed which continuously form, fill and seal bags or pouches. These machines utilize continuous rolls of heat sealable film which are heat sealed together to form bags or pouches. Typically side seals or joints are continuously made between a front and a back film, a bottom seal is then made, the bag or pouch filled and the bag or pouch completed by forming a top seal.

Most of the form, fill and seal bagging machines presently utilized, are utilized for convenience foods and/or packaging of food condiments. Typically a gang of side seals, i.e. the hardware that joins the films, will be lined up in parallel across the width of the continuous front and back films. These form individual parallel side seals, i.e. elongated areas where the films are joined together, which are spaced apart from each other at varying widths of from approximately 1½ inches, which would be utilized for condiment packaging, to approximately 12 inches, which would be utilized for food or other items. Typically the rolls of film utilized for the front and back surfaces will be approximately 12 to 24 inches in width and as such simultaneously anywhere from two to approximately a dozen or so bags or pouches can be concurrently formed, filled and sealed by the machine.

As the continuous front and back films move through the machine, at least two or more side seams (joined areas) are formed between these films. This forms the side edges of parallel bags. These side seams are then cut or severed to separate the individual parallel bags. A cross or transverse seal (joined area) is then made across the width of the film. This seal is normally made much wider than the side seals and is split such that concurrently a top seal will be made for the bottom most of two adjoining or adjacent pouches and a bottom seal will be made for the top most of the two adjoining or adjacent pouches.

After the bottom seal is made, the pouch is ready for filling with an appropriate product. The hardware utilized to fill the pouch with product and the filling process itself is dependent upon the product which is being packaged. For certain condiment packages such as catsup, mustard or the like the product is generally added to small pouches being formed in parallel with one another utilizing parallel spaced filling tubes which simply inject an aliquot of the condiment into the pouches. For other products, however, the filling operation is somewhat more complex.

Soups, sauces and other similar products are generally at least partially cooked prior to packaging. In order to prevent spoilage and to insure freshness of the product, packaging of the product while it is still hot is advantageous. Further, in certain instances it is advantageous to seal the product within the bag or pouch and concurrently exclude oxygen from the product or the pouch to inhibit certain chemical and biological processes between the product and atmospheric oxygen.

When a product is packaged while it is hot, most often steaming hot, condensation of the steam on the interior sides of the packaging can occur. This condensation will interfere with the final sealing, i.e. the formation of the top seal of the pouch or bag. Thus, it is also desirable to eliminate steam from the interior of the bag or pouch just prior to sealing of the bag or pouch.

After loading the product in the bag or pouch, the bag or pouch is sealed by forming a top seal between the two side seals. The top seal of one bag or pouch, i.e. product containing bag, is made concurrently with the bottom seal of the next adjacent empty bag or pouch. This combination cross or transverse seal is generally made utilizing a hardware component called a head seal. This forms a seal, i.e. an elongated joint between the front and back film which is wide enough to serve both as a top seal for one package and a bottom seal for another package. This head seal can include a cut off knife or an independent cut off mechanism can be located below the head seal to sever the cross seam to form individual top seals and bottom seals on adjacent bags or pouches.

Both the head seal utilized to form the bottom and top seals and the side seals (hardware) to form the side seals (joints) are generally formed of metallic elements which have resistance heaters located in these elements to heat these metallic elements. A back and a front heated metallic element are brought together squeezing the front and back films between them to seal the front and back films together to form an impervious seal or joint between these two films.

The side seals or joints can be made in a continuous manner as the rolls of the film are threaded through the side seals (hardware). The cross or transverse seal made by the head seal is formed intermittently during the cycling of the bagging machine. Thus, a cross seal is made to seal up an already filled bag and to form the bottom seam on the next bag to be loaded with product. The loaded bag is discharged from the machine simultaneously with the loading of the product in the next bag. The now newly loaded bag is then contacted once again with the head seal to form a top seal on this loaded bag and to concurrently form the bottom seal on the next bag which is to be loaded.

If water condensation takes place on the interior surfaces of the film in the area where the cross or transverse seal will be formed this can result in improper sealing of the films together resulting in the formation of voids or moisture pockets in the cross seal. If moisture was trapped in the cross seal, after severing two adjacent bags from one another the bag which has been loaded with product and sealed is susceptible to leakage. Further, the next adjacent bag being processed on the bagging machine can leak during the actual filling of the bag since it now has a perforated bottom seal.

In order to circumvent the problem of having moisture or other contaminants in the area which will ultimately form the cross seal, certain expedients have been resorted to such as squeegeeing moisture or product out of this area just prior to formation of the seal. One such apparatus for doing this is disclosed is U.S. Pat. No. 3,673,041. Such squeegeeing techniques, while being utilitarian, only attempt to correct a problem after it has occurred. They are not prophylactic in nature, that is they do not prevent the problem. If for one reason or another the squeegeeing effect is incomplete, material will be left on the films and an improper and leaking seal will result.

BRIEF DESCRIPTION OF THE INVENTION

In view of the above it is considered that there exists a need for new and improved processes and apparatus for controlling the atmospheres within bags or pouches during filling of the bags or pouches. It is a broad object of this invention to provide such processes and apparatus. It is a further object of this invention to provide for atmospheric control processes and apparatus utilized for these processes which are simple in operation and construction and therefore susceptible to being utilized in automated machinery for the continuous production of form, fill and seal bags on a bagging machine with the minimum of seal failures inherent in these bags or pouches. Other objects of this invention will also become apparent from the remainder of this specification.

These and other objects can be advantageously achieved in a filling head for a form, fill and seal bagging machine which comprises a product discharge means for dispensing a product into the interior of a bag being formed, filled and sealed on a bagging machine. A gas discharge means for supplying gas to the interior of the bag is associated with the product discharge means. Further, a fluid return means for removing fluid from the bag interior is also associated with the product discharge means. A housing means is provided for supporting at least the product discharge means within the interior of the bag.

The housing means can include a spreader means for spreading and maintaining a front sealable film and a rear sealable film utilized in forming a bag on the bagging machine separated apart from one another along at least a portion of an interior surface of the front sealable film and at least along a portion of an interior surface of the back sealable film such that gas can flow past the portions of said interior surfaces of the bag between the gas discharge means and the fluid return means.

In an illustrative embodiment of the invention the fluid return means would include at least one fluid return orifice for conducting fluid out of the bag and a gas discharge means would include at least one gas discharge orifice for discharging gas into the bag. In one embodiment of the invention the gas discharge means would include two of said gas discharge orifices with said fluid return orifice being located elevated with respect to both of the gas discharge orifices. In a further embodiment of the invention the fluid return means would include at least two of the fluid return orifices with the gas discharge orifice being elevated with respect to the fluid return orifice. Further, these illustrative embodiments can include the product discharge means including at least one product discharge orifice. This product discharge orifice would be associated with whichever of the fluid return orifices of the gas discharge orifices that is not elevated. That is, it would be associated with the lowermost of either of the fluid return orifices or the gas discharge orifices.

The spreader means can advantageously be shaped as a filling head which is sized and shaped to extend across the width of the interior of the bag essentially between the side seals of the bag. This filling head would be of a width less than the width of the bag but approaching the width of the bag as measured between the side seals of the bag to essentially extend across the totality of the width of the interior of the bag. Further, the filling head would be of a thickness which is much less than its width to essentially maintain the bag in a flattened orientation during filling. This prevents bulging at the center of the bag.

A vacuum means for generating a negative pressure with respect to the ambient pressure would be associated with the fluid return means to provide for a negative pressure at the fluid return means. A pressurizing means would be associated with the gas discharge means to provide a positive gas pressure with respect to the ambient pressure at the gas discharge means. For advantageous removal of moisture from the interior of the bag during packaging of a hot product having a liquid content therein, the pressurizing means would supply hot dry air to the gas discharge means for conducting this hot dry air to the interior of the bag. In other embodiments the pressurizing means would supply an appropriate inert gas for displacing atmospheric air from the interior of the bag.

The objects of the invention can also advantageously be achieved in a process of filling a bag formed on a form, fill and seal bagging machine of the type wherein the bag is formed from first and second sealable films which are continuously joined together to form side seals and then are further joined together along a bottom edge or a bottom seal wherein the process includes locating a filling head between the first and second sealable films between the side seal and displaced upwardly from the bottom seal. The filling head would be of the type having at least one product discharge orifice and at least one gas discharge orifice or a fluid return orifice. Further, the other of a gas discharge orifice or fluid return orifice would be located in association with the filling head but elevated with respect to the filling head. The process further includes creating a vacuum at the fluid return orifice to create an area of low pressure within the interior of the bag and then dispensing product from the product discharge orifice for a time sufficient to dispense an aliquot of the product in the interior of the bag and concurrently discharging a gas from the gas orifice into the interior of the bag.

For dispensing a steaming hot liquid product into a bag, the process would include discharging a gas into the bag at least concurrently with discharge of the product into the bag. For dispensing a gas which is inert with respect to the product located in a bag, the gas would be discharged into the bag to displace the atmosphere in the bag and the bag sealed to retain at least a residual component of the gas in the bag.

BRIEF DESCRIPTION OF THE DRAWINGS

This invention will be better understood when taken in conjunction with the drawings wherein:

FIG. 3 is a front elevational view in partial section of a bag or pouch during filling of that bag or pouch with product on the representational bagging machine of FIG. 1;

FIG. 4 is a plan view about the line 4—4 of FIG. 3; and

FIG. 5 is a side elevational about the line 5—5 of FIG. 3.

This invention utilizes certain principles and/or concepts which are set forth in the claims appended hereto. Those skilled in the packaging arts will realize that these principles and/or concepts are capable of being utilized in a variety of embodiments which may differ from the exact embodiments utilized for illustrative purposes herein. For this reason this invention is not to be construed as being limited solely to the illustrative embodiments but should only be constructed in light of the claims.

DETAILED DESCRIPTION OF THE INVENTION

Figure 1:
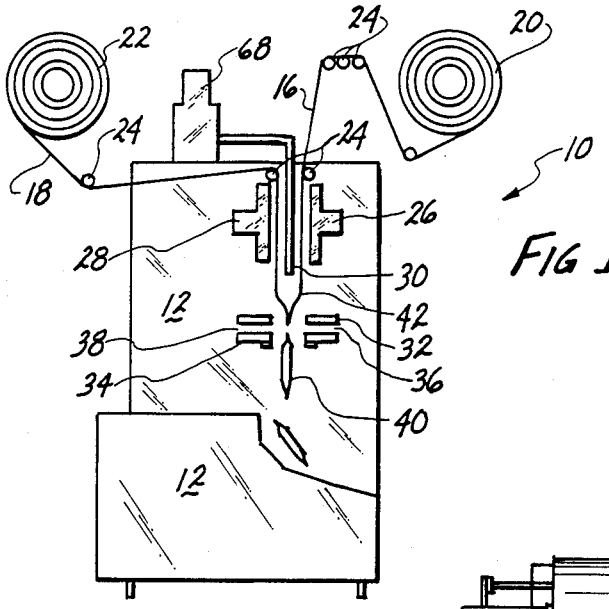
FIG. 1 is a side elevational view of a representational fill, form and seal bagging machine.
Figure 2:
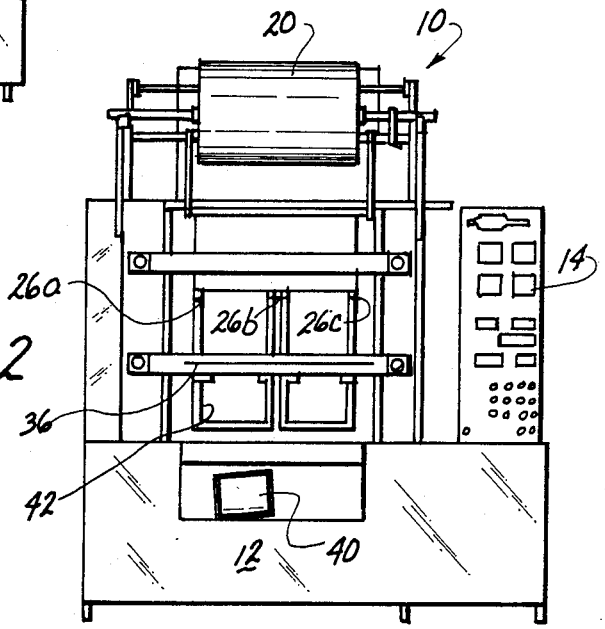
FIG. 2 is a front elevational view of the representational machine of FIG. 1.

In FIGS. 1 and 2 a typical, commercially available form, fill and seal bagging or pouching machine is illustrated in a schematic manner. Insofar as these types of machines are commercially available, only those components which are necessary to the understanding of this invention will be discussed and they will be discussed in an abbreviated schematic like manner.

The machine 10 has a housing 12. As seen in FIG. 2 on the right side of the housing 12 is a control unit 14. These represent typical commercially available machines, as for instance, a L12, and L18 or a L25 Form, Fill and Seal Bag and Pouch Machines available from Lane Manufacturing, 998 South Sierra Way, San Bernardino, Calif. 92408. These machines utilize a variety of microprocessors within the control unit 14 to control the functions of the machine 10. Typically these machines are set up to be able to run for a full shift, i.e. 8 hours, with only minimal operator attention.

The machine 10 utilizes a front heat sealing film 16 and a rear heat sealing 18 which are loaded onto the machine 10 typically as continuous rolls 20 and 22. Typically the films 16 and 18 would be films which are 24 inches wide and the rolls 20 and 22 would be of a sufficient length to form a roll of approximately 28 inches in diameter which would serve to supply the machine 10 for the totality of a typical 8 hour shift of run time. In any event the films 16 and 18 are threaded through appropriate supply rollers collectively identified by the numeral 24 such that they become positioned next to and overlaying one another.

The front film 16 and the rear film 18 are fed between front and rear side seal bars 26 and 28 (heat sealing hardware units). These form continuous seals or joints between the front and rear film 16 and 18. As shown in FIG. 2 the machine 10 utilizes 3 front side seal bars, bars 26A, 26B and 26C. Three corresponding rear side seal bars 28 would be located directly behind the front side seal bars 26. Thus as used, the machine 10 produces two side by side or parallel pouches or bags. A left bag would be formed by side seal bars 26A and 26B and a right bag formed between side seal bars 26B and 26. Thus, if 24 inch wide film 16 and 18 is utilized, each of the left and right bags would be approximately 12 inches across in width.

As the films 16 and 18 feed past the side seal bars 26 and 28, continuous parallel side seals are formed between the front and rear films 16 and 18. If a dual bagging machine, such as that seen in FIG. 2 is being utilized, an appropriate cutter, not separately shown or numbered in FIG. 2, however as hereinafter described, severs the continuous film continuously in the middle of the center seal to create separate left and right bags or pouches. The formation of the sealed sides of the bag and the severing and cutting of them is as is standard in commercial available form, fill and seal bagging machines.

As the films 16 and 18 pass the side seal bars 26 and 28 and are joined together they form continuous "tubes" by virtue of the parallel side seals. Located in the center of these "tubes" are filling heads shown in representational form by the numeral 30 in FIG. 1 and hereinafter described in greater detail. As can be seen in FIG. 3 the filling head 30 is positioned between the front film 16 and the back film 18 downstream from the side seal bars 26 and 28. The filling heads add an aliquot of product to the bag or pouch. After loading the bag with the aliquot of product the top of the loaded bag is then sealed.

Located below the filling heads 30 are front and rear head seal bars 32 and 34 respectively. Together the front and rear head seal bars 32 and 34 form a cross seal or head seal which extends between the side seals and joins the front and rear film 16 and 18 between these side seals. This cross seal concurrently forms the top seal of a lower of two adjacent bags which contains product and the bottom seal of the upper of two adjacent bags as the films 16 and 18 advance through the bagging machine 10.

Typically the head seal bars 32 and 34 will move in and out toward and away from one another during each bagging cycle. They come together squeezing the front and rear films 16 and 18 between them and heat sealing these films together to form the cross seal or head seal. The head seal bars 32 and 34 then move away from one another in position to seal the next product containing bag by forming a top seal thereon and to concurrently also form a bottom seal for the next bag to be processed in the machine cycle.

Typically the head seal bars are mechanically or hydraulically operated such that front head seal bar 32 is moved backward towards the rear head seal bar 32 while concurrently the rear head seal bar 34 moves frontwards toward the front head seal bar 32. The head seal bars 32 and 34 engage the film and squeeze and heat the film between them to form the cross seal.

The front head seal bar 32 can include an opening 36 formed therein and likewise the rear head seal bar 34 can include an opening 38 located therein. A cut off knife can be fixed in one or the other of the slots 36 or 38 whereby it moves with the head seal to cut the film. This would separate a bottom most bag 40 which is filled with product from an upper adjacent bag 42 which is located in association with the representational filling head 30. The bottom filled bag 40 after being severed from films 16 and 18 is free to descend off the front of the bagging machine 10 into an appropriate hopper or the like for the collection of these bags. The upper bag 42 of the two adjacent bags which have been created and separated by the cross seal is now ready to be filled with an appropriate aliquot of product. After filling, bag 42 is positioned in association with the head seal bars 32 and 34 for formation of a cross seal following severing of this further bag from the stream of bags being produced by the bagging machine 10. Alternatively a cut off mechanism can be independently mounted and activated below the head seal to sever the films 16 and 18 along the cross seal as they move past it.

Since the cutting mechanism which would be utilized for severing the bag 40 from the bag 42 and other like bags from each other, is a standard mechanism as can be found on the above referenced commercial machines and since it does not form a part of this invention, for brevity of this specification and the drawings, it is not shown in the drawings or further discussed in this specification.

Referring now to FIGS. 3, 4 and 5, detailed views of an appropriate bag which is located on the machine 10 in association with the filling head is shown.

The bag 44 of FIG. 3 is positioned as per the representational bag 42 on the machine 10 of FIG. 1. At this juncture of time, side seals 46 and 48 have been formed between the front film 16, partially broken away in FIG. 3, and rear film 18. Likewise, an appropriate bottom seal 50, initially formed as part of a cross seal and then severed to separate a bottom most filled bag from the bag 44, has been formed and extends across the width of the bag 44 between the side seals 46 and 48.

Also seen in FIG. 3 are portions of the rear head seal bar 34 and its slot 38 as well as portions of the side seal bars 28A and 28B. The overlaying head seal bar 32 as well as the overlaying side seal bars 26A and 26B have been removed for clarity. As with the side seal and head seal bars of FIGS. 1 and 2, the side seal and head seal bars 28A and 28B and 34 shown in FIGS. 3 and 5 are representational in nature and since they correspond to these same components in FIGS. 1 and 2 like numerals have been utilized to identify like components.

Shown in FIG. 3 in association with the rear side seal bar 28B is a cutter 52. The cutter 52 separates the bag 44 from its right hand neighbor, bag 54 partly shown in FIG. 3. Thus, as the continuous film 16 and 18 descend past the side seal bars 26B and 28B, a seal between the two films is made down the center of these films, and then this seal is severed into two parts to divide the bag 44 from its right hand and parallel neighbor, bag 54. Identical components as are seen with the left hand bag 44 would also be associated with the bag 54, the right hand bag, for filling and atmospheric purging of that bag. Thus, for the representational machines seen in FIGS. 1 and 2, two bags would be simultaneously formed, filled and sealed. It is, of course, realized that a greater number of bags or a single bag could also be formed on a bagging machine as per the bagging machine 10 by simply using a lesser or a greater number of components, i.e. the side seal bars, the filling heads and the like utilized in association with these machines.

As seen in FIGS. 3 and 5, the bag 44, at this stage in the machine cycle is essentially a tube closed at one end, i.e. along the bottom seal 50. Its top would be open, that is it would be open above wherein the side seal bars 26 and 28 join the films 16 and 18. Extending down through this upper opening are a plurality of hollow tubes or conduits. These serve to conduct product, vacuum and pressurized gas into the interior of the tube, i.e. the bag 44. These conduits are appropriately suspended and connected to other components located on the bagging machine 10. Each of these components will be individually identified below, however, together they comprise a housing means which fits down into and is suspended on the machine 10 so the closed end tube, i.e. the bag 44, can slide down over this housing means as it is continually formed. A portion of this housing means forms a filling head while further portions form certain gas or fluid conduits located in association with the filling head.

The filling head generally depicted by the numeral 56 includes a spreader 58. The spreader has elongated front and back surfaces 60 and 62, respectively, which are of a width whereby the spreader 58 extends cross wise within the bag 44 from the side seal 46 to the other side seal 48. Further, the thickness of the spreader between the front and rear surfaces 60 and 62 of the spreader is fairly thin compared to its width. This allows the films 16 and 18 to lay rather flat against the surfaces 60 and 62 to maintain a very flat profile of the bag 44 during filling and subsequent sealing of this bag when the cross seal is formed transversely across it between the side seals 46 and 48. This assists in not only filling of the bags, but also insures that no wrinkles or the like are formed in the area where the cross seal is made.

Wrinkles could cause leaks to be formed in the cross seal which would result in defective bags. By maintaining the films 16 and 18 essentially continuously flat paralleling the surfaces 60 and 62 of the spreader 58 the films 16 and 18 are maintained essentially flat in the area within the cross seal will be formed. Further, as will be evident below, by selecting the width of the spreader essentially slightly less than the width of the interior of the bag 44 as measured between its side seals 46 and 48, even when the interior of the bag 44 is pressurized, as hereinafter explained, the shape of the bag is maintained essentially as seen in FIGS. 3, 4 and 5, during both filling and the cross sealing operations.

Product feed tubes 64 and 66 descend downwardly from a product reservoir 68 shown in FIG. 1. The product feed tubes 64 and 66 join Y shaped channels 70 and 72 formed in the spreader 58. Product discharge orifices 74 and 76 are connected to the bottom ends of the respective Y shaped channel 70 and 72.

Product control rods 78 and 80 respectively, also connect and slide in the Y shaped channels 70 and 72. When the product control rods 78 and 80 are lifted upwardly, this allows product 81 to flow down the product feed tubes 64 and 66 and be discharged from the product discharge orifices 74 and 76. Lowering the control rods 78 and 80 downwardly toward the orifices 74 and 76 seal the Y shaped channels 70 and 72 cutting off the flow of product 81 from the product discharge orifices 74 and 76. Thus, discharge of product from the discharge orifices 74 and 76 can be controlled allowing an appropriate aliquot of product 81 to be discharged into the interior of the bag 44.

As seen in FIG. 3 the control rods 78 and 80 are raised allowing product 81 to descend out of the product discharge orifices 74 and 76 into the interior of the bag 44. An appropriate aliquot of product 81 will be discharged into the bag 44. The product control rods 78 and 80 thus serve as poppet rods for the control of product 81 into the interior of the bag 44. Their movement would be controlled by appropriate mechanical devices not separately shown in the drawings or described in the specification. Insofar as these types of poppet control devices are known, for brevity of this specification, the control mechanisms for the rods 78 and 80 are not shown. In any event, for the purposes of understanding of this invention it is sufficient to note that the control rods 78 are raised and lowered as per standard poppet rods to open or seal off the Y shaped channels 70 and 72 to control the flow of product 81 out of the product discharge orifices 74 and 76. This is essentially as is standard in other bagging machines as for instance, the bagging machines identified earlier in this specification.

A central conduit 82 and right and left side conduits 84 and 86 descend parallel with the product feed tubes 74 and 76 and also pass through the spreader 58. The conduit 82 passes through the spreader 58 and opens through the bottom of the spreader 58 at orifice 88. Likewise the conduits 84 and 86 pass through the spreader 58 and open through the bottom of spreader 58 at orifices 90 and 92, respectively. The orifices 88 and 90 and 92 can therefore form ingress or egress orifices for the conduits 82, 84 and 86.

Depending upon the product 81 and other perameters as are discussed below, the conduit 82 may be utilized as a gas discharge conduit or as a fluid vacuum conduit. Likewise the conduits 84 and 86 would be utilized in tandem either as discharge conduits or fluid vacuum conduits.

Located above the spreader 58 elevated with respect to the respective orifices 74, 76, 88, 90 or 92 are further upper right side conduits 94 and upper left side conduits conduits 96. As with the conduits 82, 84 or 86 these can be utilized either for gas discharge or for fluid return, i.e. vacuum. Further, their particular use would depend upon the product 81 which is being packaged in the bag 44 and/or the atmospheric conditions associated with that product.

Additionally, if desired as, for instance, when a bag 44 was fairly large, i.e. approaching approximately a foot in width or so, central upper conduits collectively identified by the numeral 98 would be utilized in conjunction with the upper conduits 94 and 96. If conduits 94 and 96 are being utilized for gas discharge conduits the upper central conduits 98 would also be utilized for gas discharge conduits. If the conduits 94 and 96 are being utilized for vacuum conduits the conduits 98 would also be utilized as vacuum conduits. The conduits 98 are utilized in those situations wherein because of the bag volume it is desirous to increase either the volume of gas being discharged into the bag 44 or increase the volume of gas which is being removed from the interior of the bag 44.

The conduits 82, 84, 86, 94 and conduits 96 and 98 if they are present, would be connected through standard flow valves, tubing and the like to either a source of pressurized gas, i.e. a positive pressure source compared to the ambient pressure , or a source of fluid removal, i.e. a vacuum source or negative pressure source with respect to the ambient pressure. Suitable for use as the vacuum source would be a regenerative blower, a venturi aspirator, a vacuum pump or any other suitable source of negative pressure. Insofar as these types of negative pressure devices are well known and commercial embodiments are available in the market place, an exact description of such a source of negative pressure is not necessary for the understanding of this invention. It is sufficient to note that a suitable commercial device capable of generating negative pressure would be connected to the appropriate conduits utilized via appropriate valves or the like.

In a similar manner, an appropriate source of positive pressure would also be connected to the appropriate conduits. In one instance this source of positive pressure would be a source of heated dry air. This can be generated utilizing an appropriate burner, electric heater or the like, again utilizing known devices. Further, appropriate source of compressed gasses such as compressed nitrogen, compressed argon, compressed carbon dioxide or the like might also be utilized to supply positive gas pressure. For high pressure pressurized bottled nitrogen, carbon dioxide or other gas, appropriate flow and pressure control valves would be used to reduce the bottle pressure to supply these gases at a lower pressure to the interior of a bag. If supplied by an appropriate hot air burner or hot air source, the gas would be pressurized by suitable fans, compressors or the like.

As per further description of the invention below, hot dry gas can be supplied to the interior of the bag 44. This would be utilized in conjunction with hot liquid product. Since a hot liquid product could be at or near the boiling point of the liquid component of this product, the carrier liquid of the product could exist in both the liquid and the gas state. Condensation from the gas to the liquid state of the product 81 could occur in appropriate vacuum or return conduits. For this reason these are referred to as fluid conduits to indicate that if condensation of hot gasses occur to the liquid state both the hot gasses or the liquids would be removed from the interior of the bag via these return or vacuum conduits. Thus, the word fluid will be utilized to describe both the gasses and their potential condensation products. Actual product 81 itself, however, would not be "vacuumed" up by the vacuum or return conduits. It would only be that portion of the carrier fluid of the product 81 which pass from the gas state and cool to the liquid state that would be included within this fluid definition.

Since the bagging machine 10 in FIGS. 1 and 2 is useful for bagging a variety of products and since the filling head 56 is also utilized for dispensing a variety of these products, depending upon the produce, i.e. its temperature and the final atmosphere desirable within the interior of a sealed bag, different combinations of gas discharge and fluid return conduits will be utilized.

Further, since most of products which are packaged in the bags or pouches produced by the bagging machine 10 of the Figures are food products which are either of vegetable or animal origin, they will vary depending upon growing, harvesting and other processing perameters of these products. As, for instance, tomatoes picked early in the season might differ in fiber content from tomatoes picked later in the season and thus the early tomatoes when utilized in a pizza sauce might have different product characteristics than later tomatoes utilized in different tomato product. Because of this the series of conduits, both the upper conduits and the lower conduits located at either the central or the outboard positions, i.e. the center and the left and right conduits, can be used in a variety of combinations or configurations.

In any event, one of gas discharged or fluid returned will occur at the lower orifices 88, 90 or 92 in conjunction with dispensing of product 81 from the product orifices 74 and 76. The other of the gas discharge or fluid return will then occur via the upper conduits 94, 96 or 98.

During the filling of a steaming hot product 81, via product discharge orifices 74 and 76, into the bag 44 it naturally cools as it transfers heat to the bag 44. In prior art processes during the loading of such a hot steaming product into a bag, steam from the product naturally condenses on the inside surfaces of the bag it is being loaded into. This contaminates the inside surfaces of the bag. As a result of this ineffective seals are then formed when the bag is cross sealed.

By introducing a hot, dry gas into the interior of the bag 44 in conjunction with introduction of the hot product 81, and by providing for a source of negative pressure to provide for continuous gas flow within the interior of the bag 44, condensation of steam as liquid droplets on the interior surfaces of the bag 44 or the exterior of the spreader 58 is inhibited. Thus, the interior surfaces of the films 16 and 18 within the bag 44 stay clean and dry. When a cross seal is then made on the bag 44 to seal the product 81 in the bag 44, since the interior surfaces of the film 16 and 18 are clean and dry, a continuous cross seal is formed which has no irregularities, voids or other defects incorporated therein. Thus, the bag or pouch is properly formed and will not leak.

Preferredly for filling of hot thick product 81 into the bag 44, vacuum or low pressure will be applied to the conduit 82 and thus place the orifice 88 at a point of low pressure with respect to its surrounding environment. Concurrently, hot dry air will be supplied to the interior of the bag 44 via the upper right and left conduits 94 and 96 for a small bag and via all of the upper conduits 94, 96 and 98 for a larger bag. Thus, a positive pressure with respect to the ambient pressure is created above the spreader 58 and a source of negative pressure with respect to the ambient pressure is created below the spreader 58.

The hot dry air introduced into the upper portion of the bag 44 is directed downwardly because of the orientation of the conduits 94, 96 and 98 which open downwardly. Even though the upper end of the bag is "open" , by downwardly directing the conduits 94, 96 and 98 in association with the creation of source of low pressure below the spreader 58, gas flow will generally be downward within the bag 44 from the top of the spreader 58 around the sides of the spreader to the bottom of the spreader 58. This gas flow brings the hot dry air in contact with the surfaces of the interior of the bag, i.e. the interior surfaces of the films 16 and 18 and maintains them dry and free of all condensation. As the hot dry air sweeps down over the sides of the spreader 58 it entrains within its gas stream any steam or the like which is being discharged from the product discharge orifices 74 or 76 or off of the surface of the product 81 already in the bag 44 and conducts this steam through the orifice 88 into the return conduit 82 which is at a low pressure.

After an appropriate aliquot of product has been discharged from the discharge orifices 74 and 76, the product flow is terminated by lowering of the control rods 78 and 80. Hot air injection via the conduits 94 and 96 of alternatively the conduits 94, 96 in conjunction with the conduits 98 is maintained on a continuous basis as is fluid removal or return via orifice 88 feeding the conduit 82. Thus, the interior surfaces of the bag 44 are kept dry awaiting formation of the cross seal by the head seal bars 32 and 34.

If a hot thin product, i.e. runny or very fluid product, is being packaged in the bag 42, for small and medium size bags generally hot air will be fed to the conduit 82 for discharge from the orifice 88. The conduits 94 and 96 and/or the conduits 94, 96 plus 98 will be utilized as return or vacuum conduits. In larger bags, hot air might also be discharged from the orifices 90 and 92. By discharging the hot air at the bottom of the spreader 58, splashing of the runny product is prevented such that the product itself does not contaminate the interior surfaces of the bag 44.

Since the hot air, when it contacts the walls of the bag 44 will lose heat to the bag, it will tend to cool and therefore change its dew point. By injecting the hot air on the bottom side of the spreader 58 for use in a very thin runny product, cooling of the air is kept at a minimum to keep temperature loss of this air at a minimum and condensation from this hot runny product at a minimum.

Generally, for use with hot products, below the spreader 58 either air injection, i.e. pressure increase, or fluid removal, i.e. pressure decrease or vacuuming, will occur at the center orifice 88 and the other of these, i.e. air injection or fluid removal, will occur above the spreader 58 near the outside edges, i.e. conduits 94 and 96. Thus, generally for thick products vacuum will be imposed at the center lower orifice 88 and hot air injected at the upper outer conduits 94 and 96 and for hot thin product air will be injected from the bottom center orifice 88 and vacuum at the upper outer conduits 94 and 96. This tends to keep air flow moving across the full outside surface of the spreader 58, i.e. its front and back surfaces 60 and 62 as well as along its edges. This serves to keep product and condensation off of the sides of the walls of the spreader and most importantly off of the interior of the bag 44. In any event, the air flow between the sides of the bag 44 across the outside surfaces of the spreader 58 in association with the shape of the spreader 58 serves in maintaining a very narrow profile for the bag 44 which assists in formation of an imperforate cross seal. This is especially true in large heavy bags.

Other gasses other than hot air could also be utilized in association with filling the bag 44 with a hot product. Such other gasses might be sterilized hot air, carbon dioxide, or nitrogen. These other gasses would provide for additional utilities other than the moisture removal utility of heated air. These other gasses could be utilized to enhance the preservation of the product 81 within the bag 42. In a like manner, depending upon the particular product which is being packaged these other gasses can also be utilized during a cold fill of product, that is a non-heated product. With certain products, depending upon the characteristics of the product, nitrogen or carbon dioxide fill is utilized for preservation of that product. For more critical products, as for instance, pharmaceuticals, other gasses such as argon might be utilized.

When a displaced atmosphere is desired in the bag 44, the displacing gas, i.e. as for instance nitrogen, might be injected into the bag 44 via all three of the conduits 82, 84 and 86 to insure that the displaced gas as for instance air, would be totally removed from the surface above the product 81. Gas or gas removal would then occur at the upper conduits 94 and 96 and/or 98. If any air is entrained in the product as it is discharged from the product discharge orifices 74 and 76 the gas purged via the orifice 88 or in combination the orifices 90 and 92 or in combination all three of these orifices 88, 90 and 92 would remove such entrained air and leave the purging atmosphere located over the product in the bottom of the bag 44.

The spreaders utilized in this invention and the atmospheric controls which are achieved can be used on bags of various sizes. They can be sized from a single bag which would span the entire width of the film to very small sizes which would be used in multiples across the width of the bagging machine.

I claim:

1. A filling head for a form, fill and seal bagging machine which comprises:

a product discharge means for dispensing a product into the interior of a bag being formed, filled and sealed on said bagging machine;

a gas discharge means for supplying a gas to said bag interior;

a fluid return means for removing fluid from said bag interior;

a housing means for supporting at least said product discharge means within said interior of said bag;

said housing means including a spreader means for spreading and maintaining a front sealable film and a rear sealable film utilized in forming said bag separated apart from each other along the interior surfaces of said front and said rear sealable films, said spreader means having a bottom, a top, and a continuous surface between said bottom and said top;

said product discharge means including at least one product discharge orifice discharging product into said bag;

said product discharge orifice located with one of said fluid return orifice or said gas discharge orifice on said bottom of said spreader means with said product discharge orifice being positioned in a lower position on said bottom of said spreader means than said one of said fluid return orifice or said gas discharge orifice;

the other of said fluid return orifice or said gas discharge orifice located at an elevated position above said top of said spreader means whereby gas discharged into the interior of said bag flows between the interior surface of said bag and said continuous surface of said spreader means between said gas discharge means and said fluid return means.

2. The filling head of claim 1 wherein:

said fluid return means includes at last one fluid return orifice for conducting fluid out of said bag; and said gas discharge means includes at least one gas discharge orifice for discharging gas into said bag.

3. The filling head of claim 2 wherein:

said fluid return means includes at least two fluid return orifices, said fluid return orifices located at an elevated position within the interior of said bag with respect to the position of said discharge orifice in said bag.

4. The filling head of claim 2 wherein:

said gas discharge means includes at least two gas discharge orifices, said discharge orifices located at an elevated position within the interior of said bag with respect to the position of said fluid return orifice in the bag.

5. In combination with a form, fill and seal bagging machine of the type wherein a bag is formed from first and second sealable films which are continuously joined together along side seals and are further joined together along a bottom seal prior to being filled with a product and then are joined together along a top seal to seal the product within the interior of the bag, an improvement which comprises:

a filling head, said filling head sized and shaped to extend across said interior of said bag and of a size and shape smaller than the width of said interior of said bag but of a size approaching the width of said interior of said bag to essentially extend across the totality of the width of the interior of said bag and be positioned adjacent to but spaced away from the interior surface of said bag;

supporting means for supporting said filling head on said bagging machine in a location between the interior of said first and second films between said side seals and elevated above said bottom seal directly adjacent the interior surface of said bag with no further structure located between said filling head and the interior surface of said bag;

said filling head including a product discharge means for dispensing a product downward in said bag to be sealed in said bag;

a gas discharge means for discharging gas within said interior of said bag;

a fluid return means for removing fluid from the interior of said bag;

said filling head including one of said gas discharge means or said fluid return means positioned adjacent said product discharge means; and the other of said gas discharge means or said fluid return means located within the interior of said bag in an elevated position with respect to said filling head and displaced inwardly from the interior surface of said bag so as not to contact said interior surface of said bag whereby a pressure differential is created by said gas discharge means and said fluid return means in the interior of said bag between the interior surface of said bag and said filling head.

6. The improvement of claim 5 wherein:

said filling head includes front and back essentially flat surfaces which extend essentially parallel to said first and second films between said side seals of said bag; and said bagging machine further including vacuum means for creating a negative pressure with respect to ambient pressure, said vacuum means operative associated with said fluid return means for creating a negative pressure at said fluid return means whereby said negative pressure created at said fluid return means is propagated to said interior of said bag to aspirate said interior of said bag.

7. The improvement of claim 5 wherein:

said gas discharge means includes pressure means for creating a positive pressure with respect to ambient pressure, said pressure means operatively associated with said gas discharge means for increasing the pressure in at least a portion of the interior of said bag.

8. A process of filling a bag formed on a form, fill and seal bagging machine of the type wherein a bag is formed from first and second sealable films which are continuously joined together along side seals and are further joined together along a bottom seal, said process comprising:

selecting a filling head of a size and shape so as to extend across the interior of the bag yet of a size and shape smaller than the width of the interior of the bag but of a size approaching the width of the interior of the bag so as to essentially extend across the totality of the width of the interior of the bag and be positioned adjacent to but spaced from the interior surfaces of the bag;

locating said filling head between said first and second sealable films between said side seals and displaced upwardly from said bottom seal and directly adjacent to the interior surface of the bag with no further structure located between the filling head and the interior surface of the bag, said filling head having at least one product discharge orifice, said filling head further having at least one of a gas discharge orifice or a fluid return orifice;

locating the other of a gas discharge orifice or a fluid return orifice in the interior of said bag in an elevated position with respect to said filling head and displaced inwardly from the interior surface of the bag so as not to contact said interior surface of the bag;

creating a negative pressure with respect to ambient pressure at said fluid return orifice to create a low pressure area within the interior of said bag;

discharging gas from said gas discharge orifice into the interior of said bag to cause gas flow from said gas orifice between said filling head and said interior surface of said bag to said fluid return orifice; and dispensing product from said product discharge orifice for a time sufficient to dispense an aliquot of product into the interior of said bag.

9. The process of claim 8 including:

locating said fluid return orifice in association with said product discharge orifice but at a higher location in said bag than the location of said product discharge orifice; and locating said gas discharge orifice at an elevated position with respect to both of said product discharge orifice and said fluid return orifice.

10. The process of claim 8 including:

locating said gas discharge orifice in association with said product discharge orifice but at a higher location in said bag than the location of said product discharge orifice; and locating said fluid return orifice at an elevated position within the interior of said bag with respect to both of said product discharge orifice and said gas discharge orifice.

11. The process of claim 8 further including:

continuously discharging gas into the interior of said bag during at least said dispensing of said product.

12. The process of claim 11 including:

continuously discharging said gas into said interior of said bag during dispensing of said product; and sealing said bag along a top edge to seal said product in said bag.

13. The process of claim 12 including:

heating said gas prior to dispensing said gas in the interior of said bag.

14. The process of claim 13 including:

discharging said heated gas into the interior of said bag for a time sufficient to insure that moisture condensation is inhibited within the interior of said bag prior to sealing said bag.

* * * * *

UNITED STATES PATENT AND TRADEMARK OFFICE

CERTIFICATE OF CORRECTION

PATENT NO. : 4,769,974

DATED : SEPTEMBER 13, 1988

INVENTOR(S) : STEVEN D. DAVIS

It is certified that error appears in the above-identified patent and that said Letters Patent is hereby corrected as shown below:

Column 3, line 8, "is" should be --in--(second occurrence).

Column 5, line 9, insert --view-- between "elevational" and "about".

Column 5, line 19, "constructed" should be --construed--.

Column 5, line 34, "and" should be --a--.

Column 5, line 65, "26B and 26" should be --26B and 26C--.

Column 8, line 25, "within" should be --wherein--.

Column 9, line 15, "perameters" should be --parameters--.

Column 9, line 49, "pressure , " should be --pressure, --.

Column 10, line 34, "produce" should be --product--.

Column 10, line 43, "perameters" should be --parameters--.

Column 11, line 52, "of" should be --or--.

Column 14, line 37, "operative" should be --operatively--.

Signed and Sealed this

Twenty-fourth Day of July, 1990

*Attest:*

HARRY F. MANBECK, JR.

*Attesting Officer*

*Commissioner of Patents and Trademarks*